US010175596B2

(12) United States Patent
Tsuchihashi

(10) Patent No.: US 10,175,596 B2
(45) Date of Patent: Jan. 8, 2019

(54) ELECTROSTATIC LATENT IMAGE DEVELOPING TONER

(71) Applicant: KYOCERA Document Solutions Inc., Osaka (JP)

(72) Inventor: Kazuki Tsuchihashi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/740,530

(22) PCT Filed: Mar. 15, 2017

(86) PCT No.: PCT/JP2017/010384
§ 371 (c)(1),
(2) Date: Dec. 28, 2017

(87) PCT Pub. No.: WO2017/179357
PCT Pub. Date: Oct. 19, 2017

(65) Prior Publication Data

US 2018/0196368 A1 Jul. 12, 2018

(30) Foreign Application Priority Data

Apr. 14, 2016 (JP) ..... 2016-081028

(51) Int. Cl.
*G03G 9/093* (2006.01)
*G03G 9/08* (2006.01)
*G03G 9/087* (2006.01)

(52) U.S. Cl.
CPC ..... *G03G 9/09321* (2013.01); *G03G 9/08* (2013.01); *G03G 9/081* (2013.01); *G03G 9/087* (2013.01); *G03G 9/0819* (2013.01); *G03G 9/0825* (2013.01); *G03G 9/08755* (2013.01); *G03G 9/08782* (2013.01); *G03G 9/08797* (2013.01); *G03G 9/09371* (2013.01); *G03G 9/09378* (2013.01)

(58) Field of Classification Search
CPC ..... G03G 9/09321; G03G 9/09371; G03G 9/08782; G03G 9/0825; G03G 9/09378
USPC ..... 430/110.1, 110.2
See application file for complete search history.

(56) References Cited

U.S. PATENT DOCUMENTS

| | | | |
|---|---|---|---|
| 7,413,839 | B2 | 8/2008 | Matsumoto et al. |
| 7,550,243 | B2 | 6/2009 | Matsumoto et al. |
| 8,431,304 | B2 | 4/2013 | Sugimoto et al. |
| 9,448,501 | B2 | 9/2016 | Inoue et al. |
| 2005/0214670 | A1 | 9/2005 | Matsumoto et al. |
| 2008/0254378 | A1 | 10/2008 | Matsumoto et al. |
| 2012/0052431 | A1 | 3/2012 | Hozumi et al. |
| 2012/0052434 | A1 | 3/2012 | Sugimoto et al. |
| 2014/0363209 | A1 | 12/2014 | Inoue et al. |
| 2016/0363878 | A1* | 12/2016 | Hama ..... G03G 9/08755 |

FOREIGN PATENT DOCUMENTS

| | | | |
|---|---|---|---|
| JP | 2006-138919 | A | 6/2006 |
| JP | 2006-195260 | A | 7/2006 |
| JP | 2006-276044 | A | 10/2006 |
| JP | 2012-047990 | A | 3/2012 |
| JP | 2012-053196 | A | 3/2012 |
| JP | 2013-200559 | A | 10/2013 |

OTHER PUBLICATIONS

International Search Report issued in PCT/JP2017/010384; dated May 30, 2017.

* cited by examiner

*Primary Examiner* — Janis L Dote
(74) *Attorney, Agent, or Firm* — Studebaker & Brackett PC

(57) ABSTRACT

An electrostatic latent image developing toner includes plural toner particles containing a crystalline resin, a non-crystalline resin, and a plurality of releasing agent domains. The number of releasing agent domains having a dispersion diameter of at least 50 nm and no greater than 700 nm is at least 15 and no greater than 50 per one toner particle in cross-sections of the toner particles. A total area of the releasing agent domains having a dispersion diameter of at least 50 nm and no greater than 700 nm in the cross-sections of the toner particles is at least 5% and no greater than 20% relative to an area of the cross sections of the toner particles.

9 Claims, 1 Drawing Sheet

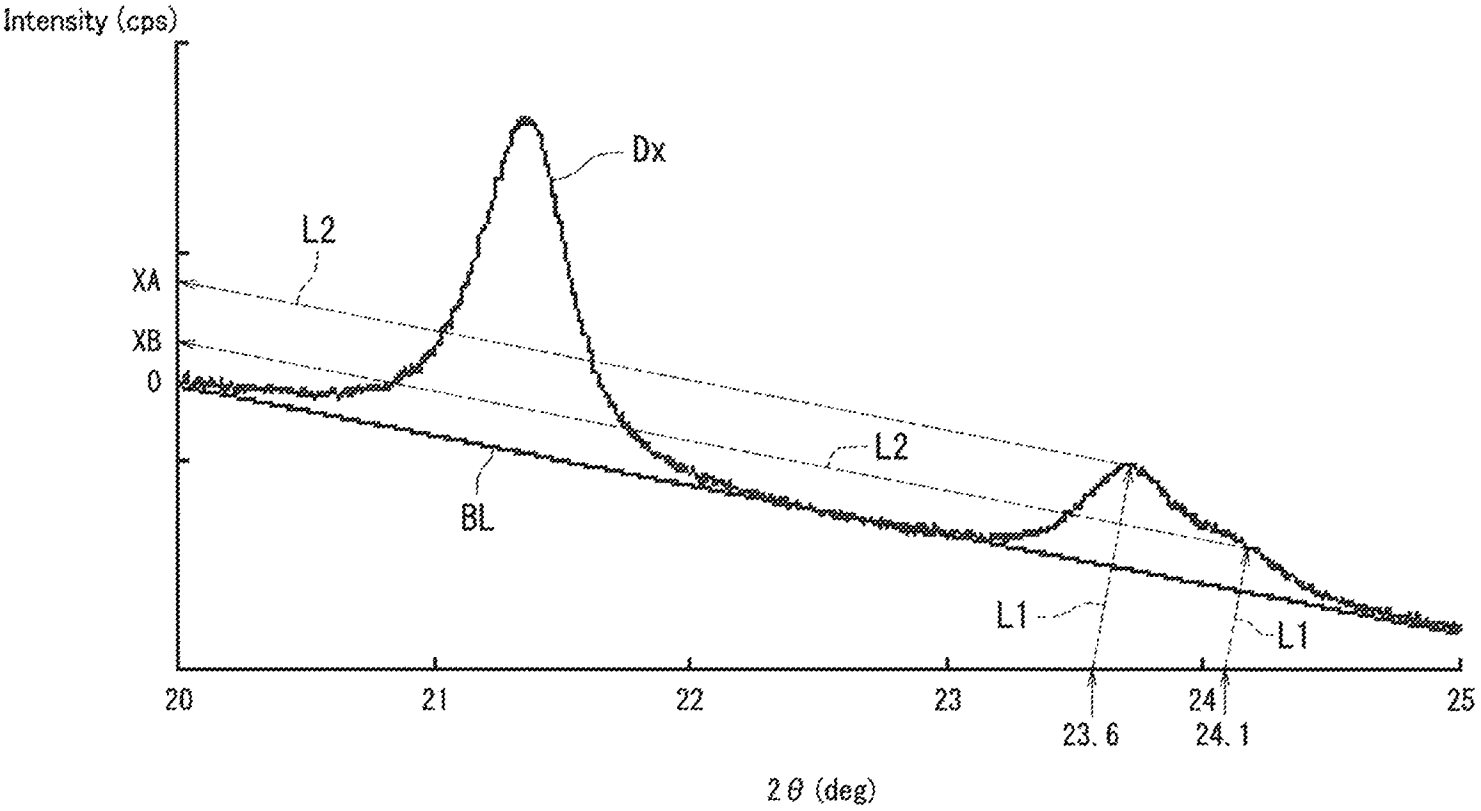
Intensity (cps)
XA
XB
0
Dx
L2
L2
BL
L1
L1
23.6
24.1
20
21
22
23
24
25
2θ (deg)

ELECTROSTATIC LATENT IMAGE DEVELOPING TONER

TECHNICAL FIELD

The present invention relates to an electrostatic latent image developing toner and a method of producing the same.

BACKGROUND ART

Patent Literature 1 discloses a technique for imparting both heat-resistant preservability and low-temperature fixability to a toner by making toner particles contain a crystalline resin. Patent Literature 1 also discloses a technique for setting a ratio "(CC)/((CC)+(AA))" to be at least 0.15 in an X-ray diffraction spectrum of an electrostatic latent image developing toner where (CC) represents an integrated intensity on a spectrum resulting from crystal structure and (AA) represents an integrated intensity on a spectrum resulting from non-crystal structure.

CITATION LIST

Patent Literature

[Patent Literature 1] Japanese Patent Application Laid-Open Publication No. 2013-200559

SUMMARY OF INVENTION

Technical Problem

A crystalline resin is used as a main component of a resin forming the toner particles in Patent Literature 1. It has been known that the higher the degree of crystallinity of a crystalline resin is, the more excellent the crystalline resin is. However, when the degree of crystallinity of a binder resin is too high, charge decay of the toner tends to readily occur and it is accordingly thought to be difficult to ensure a sufficient charge amount of the toner in a high-temperature and high-humidity environment. The present inventor has confirmed through an experiment that a toner including toner particles containing a crystalline resin, a non-crystalline resin, and a releasing agent, tended to readily adhere to members in the interior of an image forming apparatus (specific examples include a carrier, a photosensitive drum, and a development roller).

The present invention has been made in view of the foregoing problems and has its object of providing an electrostatic latent image developing toner that is excellent in heat-resistant preservability, low-temperature fixability, and charge decay characteristic and that hardly causes toner adhesion (for example, toner adhesion to a development sleeve) even in continuous printing, and a production method thereof.

Solution to Problem

An electrostatic latent image developing toner according to the present embodiment includes a plurality of toner particles containing a binder resin and a plurality of releasing agent domains dispersed in the binder resin. The toner particles contain a crystalline resin and a non-crystalline resin each as the binder resin. The number of releasing agent domains each having a dispersion diameter of at least 50 nm and no greater than 700 nm among the releasing agent domains is at least 15 and no greater than 50 per one toner particle in cross-sections of the respective toner particles. A total area of the releasing agent domains that each have a dispersion diameter of at least 50 nm and no greater than 700 nm in the cross-sections of the toner particles is at least 5% and no greater than 20% relative to an area of the cross-sections of the respective toner particles. An X-ray diffraction spectrum of the electrostatic latent image developing toner has an intensity value at a Bragg angle 2θ of 23.6° of at least 13,000 cps and no greater than 17,000 cps and an intensity value at a Bragg angle 2θ of 24.1° of at least 20% and no greater than 40% relative to the intensity value at a Bragg angle 2θ of 23.6°.

An electrostatic latent image developing toner production method according to the present invention includes melt-kneading, pulverizing, and performing high-temperature treatment. In the melt-kneading, toner materials including at least a crystalline resin, a non-crystalline resin, and a releasing agent are melt-kneaded to obtain a melt-kneaded substance. In the pulverizing, the melt-kneaded substance is pulverized to obtain a pulverized substance including a plurality of particles. In the performing high-temperature treatment, high-temperature treatment at a temperature of at least 40° C. and no greater than 60° C. is performed on the pulverized substance for at least 70 hours and no greater than 120 hours.

Advantageous Effects of Invention

According to the present invention, an electrostatic latent image developing toner can be provided that is excellent in heat-resistant preservability, low-temperature fixability, and charge decay characteristic and that hardly causes toner adhesion (for example, toner adhesion to a development sleeve) even in continuous printing, and a production method thereof.

BRIEF DESCRIPTION OF DRAWINGS

FIGURE is a spectral chart showing an example of an X-ray diffraction spectrum measured for an electrostatic latent image developing toner according to an embodiment of the present invention.

DESCRIPTION OF EMBODIMENTS

The following describes an embodiment of the present invention. Note that unless otherwise stated, evaluation results (for example, values indicating shapes or properties) for a powder (specific examples include toner mother particles, an external additive, and a toner) each are a number average measured for an appropriate number of particles that are selected as average particles from among the powder.

A number average particle diameter of a powder is a number average value of equivalent circular diameters of primary particles (diameters of circles having the same areas as projected areas of the respective particles) measured using a microscope unless otherwise stated. A measured value of a volume median diameter ($D_{50}$) of a powder is a value measured using "COULTER COUNTER MULTISIZER 3" produced by Beckman Coulter, Inc. based on Coulter principle (electric sensing zone method) unless otherwise stated.

In the present description, the term "-based" may be appended to the name of a chemical compound in order to form a generic name encompassing both the chemical compound itself and derivatives thereof. Also, when the term "-based" is appended to the name of a chemical compound used in the name of a polymer, the term indicates that a repeating unit of the polymer originates from the chemical compound or a derivative thereof. Subscripts "n" for repeating units in chemical formulas each represents, independently of one another, the number of repetitions (the number of moles) of a corresponding one of the repeating units. Unless otherwise stated, n (the number of repetitions) is any suitable value.

A toner according to the present embodiment can be suitably used for example as a positively chargeable toner for developing an electrostatic latent image. The toner according to the present embodiment is a powder including a plurality of toner particles (particles each having features described later). The toner may be used as a one-component developer. Alternatively, the toner may be mixed with a carrier using a mixer (for example, a ball mill) in order to prepare a two-component developer. A ferrite carrier (a powder of ferrite particles) is preferably used as the carrier in order that a high-quality image is formed. It is preferable to use magnetic carrier particles each including a carrier core and a resin layer covering the carrier core in order that high-quality images are formed for a long period of term. The carrier cores may be formed from a magnetic material (for example, a ferromagnetic material such as ferrite) or a resin in which magnetic particles are dispersed in order to impart magnetism to the carrier particles. Alternatively, the magnetic particles may be dispersed in the resin layer covering the carrier core. In order that a high-quality image is formed, the amount of the toner contained in the two-component developer is preferably at least 5 parts by mass and no greater than 15 parts by mass relative to 100 parts by mass of the carrier. A positively chargeable toner contained in a two-component developer is positively charged by friction with a carrier.

The toner according to the present embodiment can be used for image formation for example using an electrophotographic apparatus (image forming apparatus). The following describes an example of an image forming method using an electrophotographic apparatus.

First, an image forming section (for example, a charger and an exposure device) of the electrophotographic apparatus forms an electrostatic latent image on a photosensitive member (for example, a surface layer portion of a photosensitive drum) based on image data. Subsequently, a developing device (specifically, a developing device loaded with developer containing toner) of the electrophotographic apparatus supplies the toner to the photosensitive member to develop the electrostatic latent image formed on the photosensitive member. The toner is charged by friction with a carrier, a development sleeve, or a blade in the developing device before being supplied to the photosensitive member. For example, a positively chargeable toner is charged positively. In a developing process, toner (specifically, charged toner) on the development sleeve (for example, a surface layer portion of a development roller in the developing device) disposed in the vicinity of the photosensitive member is supplied to the photosensitive member to be attached to the electrostatic latent image on the photosensitive member, thereby forming a toner image on the photosensitive member. The developing device is replenished with toner for replenishment use from a toner container in compensation for consumed toner.

In a subsequent transfer process, a transfer device of the electrophotographic apparatus transfers the toner image on the photosensitive member to an intermediate transfer member (for example, a transfer belt) and further transfers the toner image on the intermediate transfer member to a recording medium (for example, paper). Thereafter, a fixing device (fixing method: nip fixing using a heating roller and a pressure roller) of the electrophotographic apparatus applies heat and pressure to the toner to fix the toner to the recording medium. As a result, an image is formed on the recording medium. A full-color image can for example be formed by superposing toner images of four different colors: black, yellow, magenta, and cyan. Note that the transfer process may be a direct transfer process by which a toner image on the photosensitive member is transferred directly to the recording medium not via the intermediate transfer member. Also, a belt fixing method may be adopted as a fixing method.

The toner according to the present embodiment includes a plurality of toner particles. The toner particles may contain an external additive. In a configuration in which the toner particles contain the external additive, the toner particles each include a toner mother particle and the external additive. The external additive is attached to surfaces of the toner mother particles. The toner mother particles contain a binder resin. The toner mother particles may contain an internal additive (for example, at least one of a releasing agent, a colorant, a charge control agent, and a magnetic powder) as necessary in addition to the binder resin. Note that the external additive may be omitted in a situation in which such an additive is not necessary. In a situation in which the external additive is omitted, the toner mother particle and the toner particle are equivalent.

The toner particles included in the toner according to the present embodiment may be either toner particles each including no shell layer (hereinafter referred to as non-capsule toner particles) or toner particles each including a shell layer (hereafter referred to as capsule toner particles). Toner mother particles of the capsule toner particles each include a core (also referred to below as a toner core) and a shell layer covering a surface of the toner core. The shell layer is substantially formed from a resin. For example, when toner cores that melt at low temperature are covered with shell layers excellent in heat resistance, a toner can have both high-temperature preservability and low-temperature fixability. An additive may be dispersed in the resin forming the shell layer.

The shell layer may entirely or partially cover the surface of the toner core. However, in order that the toner has both heat-resistant preservability and low-temperature fixability, the shell layer preferably covers at least 50% and no greater than 90% of the area of a surface region of the toner core and more preferably covers at least 60% and no greater than 85% of the area thereof. When monomers or prepolymers are added to an aqueous medium that are shell materials (materials of the shell layers) to polymerize the shell material on the surfaces of the toner cores, the shell layers tend to be formed on the surfaces of the toner cores at a coverage ratio of 100% (full coverage). By contrast, when particles (resin particles) that have been resinified in advance are used as a shell material, the shell layers can be easily formed on the surfaces of the toner cores at a coverage ratio of at least 50% and no greater than 90%.

The shell layer preferably has a thickness of at least 30 nm and no greater than 90 nm in order that the toner has both heat-resistant preservability and low-temperature fixability. The thickness of the shell layer can be measured by analysis using commercially available image analysis software (for example, "WinROOF" produced by Mitani Corporation) on a cross-sectional image of a toner particle captured using a transmission electron microscope (TEM). Note that if the thickness of the shell layer is not uniform for a single toner particle, the thickness of the shell layer is measured at each of four locations that are approximately evenly spaced (specifically, four locations at which the shell layer and two straight lines drawn to intersect at right angles at approximately the center of the toner particle in cross-section cross each other) and the arithmetic mean of the four measured values is determined to be an evaluation value (thickness of shell layer) for the toner particle. Boundaries between the toner cores and the shell layers can be determined for example by selectively dying only the shell layers among the toner cores and the shell layers.

Preferably, in order to improve charge stability of the toner, the shell layers contain a first vinyl resin including at least one repeating unit derived from a nitrogen-containing vinyl compound and a second vinyl resin including at least one repeating unit having an alcoholic hydroxyl group. Note that a vinyl resin is a polymer of vinyl compounds. The vinyl compounds each are a compound having a vinyl group ($CH_2{=}CH{-}$) or a vinyl group in which hydrogen is substituted (specific examples include ethylene, propylene, butadiene, vinyl chloride, acrylic acid, methyl acrylate, methacrylic acid, methyl methacrylate, acrylonitrile, and styrene). The vinyl compounds can each be a polymer (resin) through addition polymerization by carbon double bonding "C=C" for example included in the vinyl group.

The first vinyl resin, which includes a repeating unit derived from a nitrogen-containing vinyl compound, tends to have comparatively strong positive chargeability. A particularly preferable repeating unit derived from a nitrogen-containing vinyl compound included in the first vinyl resin is a repeating unit represented by the following formula (1).

(1)

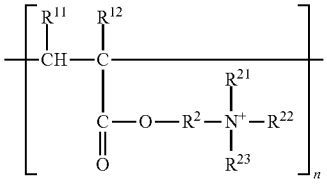

In formula (1), $R^{11}$ and $R^{12}$ each represent, independently of one another, a hydrogen atom, a halogen atom, or an optionally substituted alkyl group. $R^{21}$, $R^{22}$, and $R^{23}$ each represent, independently of one another, a hydrogen atom, an optionally substituted alkyl group, or an optionally substituted alkoxy group. Further, $R^2$ represents an optionally substituted alkylene group. $R^{11}$ and $R^{12}$ preferably each represent, independently of one another, a hydrogen atom or a methyl group. A combination of $R^{11}$ representing a hydrogen atom and $R^{12}$ representing a hydrogen atom or a methyl group is particularly preferable. $R^{21}$, $R^{22}$, and $R^{23}$ preferably each represent, independently of one another, an alkyl group having a carbon number of at least 1 and no greater than 8, and particularly preferably represent a methyl group, an ethyl group, an n-propyl group, an iso-propyl group, an n-butyl group, or an iso-butyl group. $R^2$ preferably represents an alkylene group having a carbon number of at least 1 and no greater than 6 and particularly preferably represents a methylene group or an ethylene group. Note that in a repeating unit derived from 2-(methacryloyloxy)ethyl trimethylammonium chloride, $R^{11}$ represents a hydrogen atom, $R^{12}$ represents a methyl group, $R^2$ represents an ethylene group, and $R^{21}$ to $R^{23}$ each represents a methyl group and a salt is formed by ion bonding between quaternary ammonium cation ($N^+$) and chlorine (Cl).

The second vinyl resin, which includes a repeating unit including an alcoholic hydroxyl group, tends to have comparatively strong negative chargeability. In a configuration in which the shell layers contain the second vinyl resin as above, it is though that the shell layers tend to readily bond to the binder resin of the toner cores chemically, with a result that the shell layers hardly desorb from the toner cores. A particularly preferable repeating unit including an alcoholic hydroxyl group included in the second vinyl resin is a repeating unit represented by the following formula (2), for example.

(2)

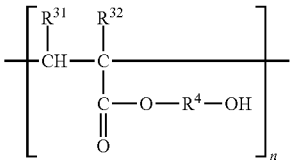

In formula (2), $R^{31}$ and $R^{32}$ each represent, independently of one another, a hydrogen atom, a halogen atom, or an optionally substituted alkyl group. $R^4$ represents an optionally substituted alkylene group. $R^{31}$ and $R^{32}$ preferably each represent, independently of one another, a hydrogen atom or a methyl group. A combination of $R^{31}$ representing a hydrogen atom and $R^{32}$ representing a hydrogen atom or a methyl group is particularly preferable. $R^4$ preferably represents an alkylene group having a carbon number of at least 1 and no greater than 6 and particularly preferably represents an alkylene group having a carbon number of at least 1 and no greater than 4. Note that in a repeating unit derived from 2-hydroxybutyl methacrylate, $R^{31}$ represents a hydrogen atom, $R^{32}$ represents a methyl group, and $R^4$ represents a butylene group ($-CH_2CH(C_2H_5)-$).

The second vinyl resin preferably includes a repeating unit derived from a styrene-based monomer in order to impart hydrophobicity to the second vinyl resin. Examples of the styrene-based monomer include styrene, α-methylstyrene, o-methylstyrene, m-methylstyrene, p-methylstyrene, p-ethylstyrene, 2,4-dimethylstyrene, p-n-butylstyrene, p-dodecylstyrene, p-methoxystyrene, p-phenylstyrene, and p-chlorostyrene. A repeating unit having the highest mole fraction among repeating units included in the second vinyl resin is preferably the repeating unit derived from a styrene-based monomer in order that the second vinyl resin has sufficiently high hydrophobicity.

The toner according to the present embodiment is an electrostatic latent image developing toner having the following features (also referred to below as basic features).

(Basic Features of Toner)

The toner includes a plurality of toner particles containing a binder resin and a plurality of releasing agent domains dispersed in the binder resin. The toner particles contain a crystalline resin and a non-crystalline resin each as the binder resin. The number of releasing agent domains each having a dispersion diameter of at least 50 nm and no greater than 700 nm among the releasing agent domains is at least 15 and no greater than 50 per one toner particle in cross-sections of the respective toner particles. A total area of the releasing agent domains that each have a dispersion diameter of at least 50 nm and no greater than 700 nm in the cross-sections of the respective toner particles is at least 5% and no greater than 20% relative to an area of the cross-sections of the respective toner particles. An X-ray diffraction spectrum (vertical axis: diffraction X-ray intensity, horizontal axis: diffraction angle) of the toner has an intensity value at a Bragg angle 2θ of 23.6° of at least 13,000 cps and no greater than 17,000 cps (cps: counts/second) and an intensity value at a Bragg angle 2θ of 24.1° of at least 20% and no greater than 40% relative the intensity value at a Bragg angle 2θ of 23.6°.

The number of releasing agent domains having a dispersion diameter of at least 50 nm and no greater than 700 nm among releasing agent domains appearing in a cross-section of a toner particle (specifically, the number thereof per one toner particle) is referred to as a specific dispersion diameter releasing agent number. The area of the cross-sections of the toner particles is referred to as a toner total sectional area. The total area of the releasing agent domains each having a dispersion diameter of at least 50 nm and no greater than 700 nm among the releasing agent domains appearing in the cross-sections of the toner particles is referred to as a specific dispersion diameter releasing agent total area. The ratio of the total specific dispersion diameter releasing agent area relative to the toner total sectional area is referred to as a specific dispersion diameter releasing agent area ratio. The specific dispersion diameter releasing agent area ratio is expressed by an expression "(specific dispersion diameter releasing agent area ratio)=100×(specific dispersion diameter releasing agent total area)/(toner total sectional area)".

In a configuration in which the toner particles contain an external additive, the toner total sectional area corresponds to an area of cross-sections of toner mother particles appearing in the cross-sections of the toner particles (inner regions defined by surfaces of the toner mother particles). In a situation in which a cross-section of a releasing agent domain appearing in a cross-section of the toner particle is not a perfect circle, an equivalent circular diameter (diameter of a circle having the same area as a projected area of the particle) corresponds to the dispersion diameter of the releasing agent domain.

The X-ray diffraction spectrum in the above basic features is an X-ray diffraction spectrum measured using an X-ray diffraction spectrometer under conditions of a tube voltage of 40 kV and a tube current of 30 mA. Intensity values at respective Bragg angles 2θ of 23.6° and 24.1° each are not necessarily a maximum intensity of a peak (intensity at the peak). FIGURE shows an example of an X-ray diffraction spectrum Dx measured under the conditions as above. The X-ray diffraction spectrum Dx shown in FIGURE has a base line BL inclined toward the horizontal axis (diffraction angle: Bragg angle 2θ) of the graph representation. In a situation in which the intensity values at the respective Bragg angles 2θ of 23.6° and 24.1° on the X-ray diffraction spectrum Dx as above are to be obtained, an auxiliary line L1 perpendicular to the base line BL is drawn from each point (Bragg angle 2θ) of 23.6° and 24.1° on the horizontal axis of the graph representation. An additional auxiliary line L2 parallel to the base line BL is drawn from an intersection point between the X-ray diffraction spectrum Dx and each auxiliary line L1, and values on the vertical axis of the graph representation (diffraction X-ray intensity value) are read (zero point: base line BL). The respective intersection points between the vertical axis of the graph representation and the auxiliary lines L2 are each determined to be a diffraction X-ray intensity at the Bragg angle 2θ. In FIGURE, an intensity value XA corresponds to an intensity value (unit: cps) at a Bragg angle 2θ of 23.6° and an intensity value XB corresponds to an intensity value (unit: cps) at a Bragg angle 2θ of 24.1°. A ratio of the intensity value XB at a Bragg angle 2θ of 24.1° relative to the intensity value XA at a Bragg angle 2θ of 23.6° can be expressed by "100×XB/XA" (unit: %).

The toner particles of the toner having the above basic features contain a crystalline resin and a non-crystalline resin each as the binder resin. When the crystalline resin in a solid state is heated, the crystalline resin tends to melt at its glass transition point (Tg) to abruptly reduce in viscosity. As such, when the toner particles contain the crystalline resin, sharp-meltability can be imparted to the toner particles. When the toner particles have sharp meltability, a toner excellent in both heat-resistant preservability and low-temperature fixability can be easily obtained. Unless the crystallinity of the crystalline resin is 100%, a crystalline region and a non-crystalline region are present in the crystalline resin.

The toner particles of the toner having the above basic features contain a releasing agent. Specifically, a plurality of releasing agent domains disperse in the binder resin contained in the toner particles. When the toner particles contain the releasing agent, fixability and offset resistance of the toner can be improved. However, in a configuration in which the toner particles contain the crystalline resin, the non-crystalline resin, and the releasing agent (releasing agent domains), the releasing agent and the non-crystalline resin (or the non-crystalline region of the crystalline resin) tend to be readily compatibilized in the toner particles to increase adhesion strength of the surfaces of the toner particles. When the adhesion strength of the surfaces of the toner particles is high, the toner tends to readily adhere to members disposed in the interior of an image forming apparatus (specific examples include a carrier, a photosensitive drum, and a development roller). In a situation in which the releasing agent and the non-crystalline resin (or the non-crystalline region of the crystalline resin) are compatibilized in the toner particles, particularly, sleeve contamination (phenomenon in which toner adheres to a surface of a development sleeve) tends to readily occur. The present inventor directed his attention to the above tendency and found that sufficient increase in crystallinity of each of the releasing agent and the crystalline resin can inhibit the binder resin and the releasing agent from being compatibilized.

When the crystallinity of each of the crystalline resin and the releasing agent in the toner particles is increased, the X-ray diffraction spectrum of the toner (electrostatic latent image developing toner) has a peak resulting from the crystal structure of the crystalline resin (specifically, the crystal region of the crystalline resin) and a peak resulting from the crystal structure of the releasing agent domains.

The peak resulting from the crystal structure of the crystalline resin in the toner particles appears around a Bragg angle 2θ of 24.1° (for example, ±0.1°) on the X-ray diffraction spectrum of the toner. The higher the intensity value at a Bragg angle 2θ of 24.1° is, the larger the crystalline region of the crystalline resin is thought to be in the toner particles. The intensity value at a Bragg angle 2θ of 24.1° is thought to increase as the crystallinity of the crystalline resin is increased. When the crystallinity of the crystalline resin is sufficiently increased, toner adhesion (for example, sleeve contamination) can be inhibited. However, too high crystallinity of the crystalline resin causes charge decay of the toner to readily occur. In particular, charge decay of the toner is significant in a high-temperature and high-humidity environment. The reason thereof is inferred to be that the crystalline region of the crystalline resin serves as a channel for charges.

The peak resulting from the crystal structure of the releasing agent domains in the toner particles appears around a Bragg angle 2θ of 23.6° (for example, ±0.1°) on the X-ray diffraction spectrum of the toner. The higher the intensity value at a Bragg angle 2θ of 23.6° is, the higher the crystallinity of the releasing agent domains is thought to be. When the crystallinity of the releasing agent domains is sufficiently increased, the binder resin and the releasing agent domains can be inhibited from being compatibilized, with a result that the releasing agent domains can be easily present in a separate state. However, too high crystallinity of the releasing agent domains causes the releasing agent to readily desorb from the toner particles. When the releasing agent desorbs from the toner particles, toner adhesion (for example, sleeve contamination) may readily occur. When the releasing agent domains are present in a dispersed state in the toner particles as defined in the above basic features, desorption of the releasing agent and toner adhesion (for example, sleeve contamination) can be inhibited. Specifically, in the toner having the above basic features, the number of releasing agent domains that each have a dispersion diameter of at least 50 nm and no greater than 700 nm is at least 15 and no greater than 50 per one toner particle in cross-sections of the respective toner particles and the total area of the releasing agent domains that each have a dispersion diameter of at least 50 nm and no greater than 700 nm in the cross-sections of the respective toner particles is at least 5% and no greater than 20% relative to an area of the cross-sections of the respective toner particles.

The present inventor has found that the specific dispersion diameter releasing agent number and the specific dispersion diameter releasing agent area ratio vary according to compatibility between the crystalline resin and the releasing agent domains in the toner particles. For example, multiple large releasing agent domains tend to be present in the toner particles of a toner in which the crystalline resin and the releasing agent domains are hardly compatibilized (also referred to below as an insufficiently compatibilized toner). The insufficiently compatibilized toner shows a tendency of the specific dispersion diameter releasing agent number being less than 15 and the specific dispersion diameter releasing agent area ratio being greater than 20% (for example, a toner TB-1 described later). A toner in which the crystalline resin and the releasing agent domains are compatibilized at a degree slightly higher than an appropriate degree (also referred to below as an excessively compatible toner) shows a tendency of multiple small releasing agent domains being present in the toner particles. Accordingly, the excessively compatible toner shows a tendency of the specific dispersion diameter releasing agent number being greater than 50 and the specific dispersion diameter releasing agent area ratio being at least 5% and no greater than 20% (for example, a toner TB-4 described later). When the crystalline resin and the releasing agent domains are more excessively compatibilized than those in the excessively compatible toner, the specific dispersion diameter releasing agent area ratio tends to be less than 5% (for example, toners TB-5 and TB-6 described later). The reason thereof is thought to extinguishment of the releasing agent domains by excessive compatibility.

As described above, the toner having the above basic features is excellent in heat-resistant preservability, low-temperature fixability, and charge decay characteristic. When continuous printing is performed using the toner having the above basic features, toner adhesion (for example, toner adhesion to a development sleeve) can hardly occur.

In order to obtain a toner suitable for image formation, the toner particularly preferably includes a plurality of non-capsule toner particles containing a melt-kneaded substance of a crystalline polyester resin, a non-crystalline polyester resin, and an internal additive and having a volume median diameter ($D_{50}$) of at least 5.5 μm and no greater than 8.0 μm.

As the amount of the crystalline resin is increased in toner production, the intensity value at a Bragg angle 2θ of 24.1° on an X-ray diffraction spectrum of a produced toner tends to increase. However, increasing the amount of the crystalline resin increases the non-crystalline region of the crystalline resin in addition to the crystalline region thereof, with a result that the releasing agent and the non-crystalline region of the crystalline resin are readily compatibilized in the toner particles. In view of the foregoing, crystallinity of each of the crystalline resin and the releasing agent in the toner particles is preferably increased in order to produce the toner having the above basic features. Specifically, in order to produce the toner having the above basic features, a production method of the toner having the feature described below (also referred to below as a preferable production method) is effective.

(Preferable Production Method)

An electrostatic latent image developing toner production method includes a melt-kneading, pulverizing, and performing high-temperature treatment. In the melt-kneading, toner materials including at least a crystalline resin, a non-crystalline resin, and a releasing agent are melt-kneaded to obtain a melt-kneaded substance. In the pulverizing, the melt-kneaded substance is pulverized to obtain a pulverized substance including a plurality of particles. In the performing high-temperature treatment, high-temperature treatment at a temperature of at least 40° C. and no greater than 60° C. is performed on the pulverized substance for at least 70 hours and no greater than 120 hours.

When the high-temperature treatment at a temperature of at least 40° C. and on greater than 60° C. is performed on the pulverized substance for at least 70 hours and no greater than 120 hours (also referred to below as high-temperature leaving) after the pulverizing in the above "preferable production method", the crystallinity of each of the crystalline resin and the releasing agent in the toner particles can be increased. In view of reduction in consumption energy and cost, the temperature in the high-temperature leaving is preferably no greater than 60° C. (more preferably, no greater than 50° C.). In view of producibility, the high-temperature leaving is preferably preformed for no greater than 120 hours (more preferably no greater than 80 hours). In a situation in which an electrostatic latent image developing toner production method includes classifying (classifying the pulverized substance) after the pulverizing, the high-temperature leaving may be performed after the pulverizing (before the classifying) or after the classifying.

In a situation in which capsule toner particles are produced according to the above "preferable production method", it is preferable that the pulverized substance subjected to the high-temperature treatment (high-temperature leaving) is put in a liquid (for example, an aqueous medium) to form shell layers that cover the surfaces of the particles included in the pulverized substance (the particles corresponding to toner cores) in the liquid after the preforming high-temperature treatment. In a situation in which the shell layers are formed on the surfaces of the toner cores in the liquid in production of the capsule toner particles, the high-temperature treatment (high-temperature leaving) for the long period of time prior to formation of the shell layers solidifies the releasing agent in the toner particles, with a result that bleeding (phenomenon of the releasing agent bleeding out of the toner particles to the surfaces of the toner particles) hardly occurs in the shell layer formation.

Note that the high-temperature leaving is not necessarily performed for producing the toner having the above basic features. For example, the present inventor has succeeded in production of the toner having the above basic features through use of a polymer of monomers (resin raw materials) including suberic acid and hexanediol as the crystalline polyester resin (for example, a toner TA-2 in Examples described later).

Examples of the shell layer formation include in-situ polymerization, in-liquid curing film coating process, and coacervation. The shell layers are preferably formed in an aqueous medium in order to inhibit dissolution or elution of the toner core components (particularly, the binder resin and the releasing agent) in shell layer formation. The aqueous medium is a medium of which main component is water (specific examples include pure water and a mixed liquid of water and a polar medium). A solute may be dissolved in the aqueous medium functioning as a solvent. A dispersoid may be dispersed in the aqueous medium functioning as a dispersion medium. Examples of the polar medium in the aqueous medium that can be used include alcohols (specific examples include methanol and ethanol). The aqueous medium has a boiling point of approximately 100° C.

The following describes a preferable example of a configuration of the non-capsule toner particles. Toner mother particles and an external additive will be described in stated order. A non-essential component (for example, an internal additive or an external additive) may be omitted in accordance with intended use of the toner.

[Toner Mother Particles]

The toner mother particles contain a binder resin. The toner mother particles may optionally contain an internal additive (for example, a colorant, a releasing agent, a charge control agent, and a magnetic powder).

(Binder Resin)

The binder resin is typically a main component (for example, at least 85% by mass) of the toner mother particles. Properties of the binder resin are therefore expected to have great influence on an overall property of the toner mother particles. In a configuration for example in which the binder resin has an ester group, a hydroxyl group, an ether group, an acid group, or a methyl group, the toner mother particles are highly likely to be anionic. In a configuration in which the binder resin has an amino group or an amide group, the toner mother particles are highly likely to be cationic.

The toner mother particles of the toner having the above basic features contain the crystalline resin and the non-crystalline resin. When the toner mother particles contain the crystalline resin, sharp-meltability can be imparted to the toner mother particles. It is preferable that a crystalline polyester resin is contained as the crystalline resin and a non-crystalline polyester resin is contained as the non-crystalline resin in order to obtain a toner suitable for image formation.

The polyester resin can be obtained by condensation polymerization of at least one polyhydric alcohol (specific examples include aliphatic diols, bisphenols, and tri- or higher-hydric alcohols listed below) and at least one polybasic carboxylic acid (specific examples include dibasic carboxylic acid and tri- or higher-basic carboxylic acids listed below).

Preferable examples of the aliphatic diols include diethylene glycol, triethylene glycol, neopentyl glycol, 1,2-propanediol, α,ω-alkanediols (specific examples include ethylene glycol, 1,3-propanediol, 1,4-butanediol, 1,5-pentanediol, 1,6-hexanediol, 1,7-heptanediole, 1,8-octanediol, 1,9-nonanediol, and 1,12-dodecanediol), 2-butene-1,4-diol, 1,4-cyclohexanedimethanol, dipropylene glycol, polyethylene glycol, polypropylene glycol, and polytetramethylene glycol.

Preferable examples of the bisphenols include bisphenol A, hydrogenated bisphenol A, bisphenol A ethylene oxide adduct, and bisphenol A propylene oxide adduct.

Preferable examples of the tri- or higher-hydric alcohols include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Preferable examples of the dibasic carboxylic acids include aromatic dicarboxylic acids (specific examples include phthalic acid, terephthalic acid, and isophthalic acid), α,ω-alkane dicarboxylic acids (specific examples include malonic acid, succinic acid, adipic acid, suberic acid, azelaic acid, sebacic acid, and 1,10-decanedicarboxylic acid), alkyl succinic acids (specific examples include n-butylsuccinic acid, isobutylsuccinic acid, n-octylsuccinic acid, n-dodecylsuccinic acid, and isododecylsuccinic acid), alkenyl succinic acids (specific examples include n-butenylsuccinic acid, isobutenylsuccinic acid, n-octenylsuccinic acid, n-dodecenylsuccinic acid, and isododecenylsuccinic acid), unsaturated dicarboxylic acids (specific examples include maleic acid, fumaric acid, citraconic acid, itaconic acid, and glutaconic acid), and cycloalkane carboxylic acids (a specific example is cyclohexanedicarboxylic acid).

Preferable examples of the tri- or higher-basic carboxylic acids include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and EMPOL trimer acid.

In a first example of a preferable toner, the non-crystalline polyester resin is a polymer of monomers (resin raw materials) including at least one bisphenol (specific examples include bisphenol A ethylene oxide adduct and bisphenol A propylene oxide adduct) and at least one dicarboxylic acid (specific examples include terephthalic acid, fumaric acid, and alkyl succinic acid) and the crystalline polyester resin is a polymer of monomers (resin raw materials) including at least one aliphatic dicarboxylic acid having a carbon number of at least 6 and no greater than 12 (specific examples include adipic acid having six carbons and suberic acid having eight carbons) and at least one aliphatic diol (specific examples include ethylene glycol, propanediol, butanediol, pentanediol, and hexanediol). A particularly preferable example of the aliphatic dicarboxylic acid having a carbon number of at least 6 and no greater than 12 is α,ω-alkane dicarboxylic acid having a carbon number of at least 6 and no greater than 12. Particularly preferable examples of the aliphatic diol include α,ω-alkanediols having a carbon number of at least 2 and no greater than 6 (specific examples include ethylene glycol having two carbons, propanediol having three carbons, and butanediol having four carbons).

In a second example of the preferable toner, the non-crystalline polyester resin is a polymer of monomers (resin raw materials) including at least one bisphenol (specific examples include bisphenol A ethylene oxide adduct and bisphenol A propylene oxide adduct) and at least one dicarboxylic acid (specific examples include terephthalic acid, fumaric acid, and alkyl succinic acid) and the crystalline polyester resin is a polymer of monomers (resin raw materials) including at least one aliphatic dicarboxylic acid having a carbon number of at least 6 and no greater than 12 (specific examples include adipic acid having six carbons and suberic acid having eight carbons), at least one aliphatic diol (specific examples include ethylene glycol, propanediol, butanediol, pentanediol, and hexanediol), and at least one bisphenol (specific examples include bisphenol A ethylene oxide adduct and bisphenol A propylene oxide adduct). A particularly preferable example of the aliphatic dicarboxylic acid having a carbon number of at least 6 and no greater than 12 is α,ω-alkane dicarboxylic acid having a carbon number of at least 6 and no greater than 12. Particularly preferable examples of the aliphatic diol include α,ω-alkanediols having a carbon number of at least 2 and no greater than 6 (specific examples include ethylene glycol having two carbons, propanediol having three carbons, and butanediol having four carbons).

The toner mother particles preferably contain a crystalline polyester resin having a crystallinity index of at least 0.90 and no greater than 1.15 in order that the toner mother particles have appropriate sharp-meltability. The crystallinity index of a resin corresponds to a ratio (=Tm/Mp) of the softening point (Tm) of the resin relative to the melting point (Mp) thereof. The definite melting point (Mp) of a non-crystalline polyester resin is often unmeasurable. Methods for measuring Mp and Tm of a resin are the same as those described later in Examples or an equivalent method thereto. The crystallinity index of a crystalline polyester resin can be adjusted by changing the type or amount of a material for synthesis of the crystalline polyester resin (for example, either or both alcohol and carboxylic acid). The toner mother particles may contain only one crystalline polyester resin or two or more crystalline polyester resins.

In order that the toner has both heat-resistant preservability and low-temperature fixability, the toner mother particles preferably contain as the binder resin a plurality of non-crystalline polyester resins having different softening points (Tm) and particularly preferably contains a non-crystalline polyester resin having a softening point of no greater than 90° C., a non-crystalline polyester resin having a softening point of at least 100° C. and no greater than 120° C., and a non-crystalline polyester resin having a softening point of at least 125° C.

A preferable example of the non-crystalline polyester resin having a softening point of no greater than 90° C. is a non-crystalline polyester resin containing bisphenol (for example, either or both bisphenol A ethylene oxide adduct and bisphenol A propylene oxide adduct) as an alcohol component and an aromatic dicarboxylic acid (for example, terephthalic acid) and an unsaturated dicarboxylic acid (for example, fumaric acid) as acid components.

A preferable example of the non-crystalline polyester resin having a softening point of at least 100° C. and no greater than 120° C. is a non-crystalline polyester resin containing bisphenol (for example, either or both bisphenol A ethylene oxide adduct and bisphenol A propylene oxide adduct) as an alcohol component and an aromatic dicarboxylic acid (for example, terephthalic acid) as an acid component, and no unsaturated dicarboxylic acid.

A preferable example of the non-crystalline polyester resin having a softening point of at least 125° C. is a non-crystalline polyester resin containing bisphenol (for example, either or both bisphenol A ethylene oxide adduct and bisphenol A propylene oxide adduct) as an alcohol component and a dicarboxylic acid having an alkyl group having a carbon number of at least 10 and no greater than 20 (for example, dodecylsuccinic acid having an alkyl group having 12 carbons), an unsaturated dicarboxylic acid (for example, fumaric acid), and a tri-basic carboxylic acid (for example, trimellitic acid) as acid components.

(Colorant)

The toner mother particles may optionally contain a colorant. The colorant can be a commonly known pigment or dye selected to match a color of the toner. The amount of the colorant in the toner mother particles is preferably at least 1 part by mass and no greater than 20 parts by mass relative to 100 parts by mass of the binder resin in order to obtain a toner suitable for image formation.

The toner mother particles may optionally contain a black colorant. The black colorant may be for example carbon black. Alternatively, a colorant that is adjusted to a black color using a yellow colorant, a magenta colorant, and a cyan colorant can for example be used as a black colorant.

The toner mother particles may contain a color colorant such as a yellow colorant, a magenta colorant, or a cyan colorant.

At least one compound selected from the group consisting of condensed azo compounds, isoindolinone compounds, anthraquinone compounds, azo metal complexes, methine compounds, and arylamide compounds can be used for example as the yellow colorant. Examples of the yellow colorant that can be preferably used include C. I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, or 194), Naphthol Yellow S, Hansa Yellow G, and C. I. Vat Yellow.

At least one compound selected from the group consisting of condensed azo compounds, diketopyrrolopyrrole compounds, anthraquinone compounds, quinacridone compounds, basic dye lake compounds, naphthol compounds, benzimidazolone compounds, thioindigo compounds, and perylene compounds can be used as the magenta colorant. Examples of the magenta colorant that can be preferably used include C. I. Pigment Red (2, 3, 5, 6, 7, 19, 23, 48:2, 48:3, 48:4, 57:1, 81:1, 122, 144, 146, 150, 166, 169, 177, 184, 185, 202, 206, 220, 221, or 254).

At least one compound selected from the group consisting of copper phthalocyanine compounds, anthraquinone compounds, and basic dye lake compounds can be used as the cyan colorant. Examples of the cyan colorant that can be preferable used include C. I. Pigment Blue (1, 7, 15, 15:1, 15:2, 15:3, 15:4, 60, 62, or 66), Phthalocyanine Blue, C. I. Vat Blue, and C. I. Acid Blue.

(Releasing Agent)

The toner mother particles may optionally contain a releasing agent. The releasing agent is for example used for the purpose of improving fixability or offset resistance of the toner. The amount of the releasing agent is preferably at least 1 part by mass and no greater than 30 parts by mass relative to 100 parts by mass of the binder resin in order to improve fixability or offset resistance of the toner.

Examples of the releasing agent that can be preferably used include: aliphatic hydrocarbon waxes such as low molecular weight polyethylene, low molecular weight polypropylene, polyolefin copolymer, polyolefin wax, microcrystalline wax, paraffin wax, and Fischer-Tropsch wax; oxides of aliphatic hydrocarbon waxes such as polyethylene oxide wax or block copolymer of polyethylene oxide wax; plant waxes such as candelilla wax, carnauba wax, Japan wax, jojoba wax, and rice wax; animal waxes such as beeswax, lanolin, and spermaceti; mineral waxes such as ozokerite, ceresin, and petrolatum; waxes having a fatty acid ester as a main component such as montanic acid ester wax and castor wax; and waxes in which a fatty acid ester has been partially or fully deoxidized such as deoxidized carnauba wax. A single releasing agent may be used or two or more releasing agents may be used in combination.

In order to inhibit charge decay of the toner and ensure sufficient heat-resistant preservability and low-temperature fixability of the toner, the releasing agent domains in the above basic features preferably contain an ester wax and particularly preferably contain both a synthetic ester wax and a natural ester wax. Use of the synthetic ester wax as the releasing agent can result in easy adjustment of the melting point of the releasing agent in a desirable range. The synthetic ester wax can be synthesized for example by reaction between an alcohol and a carboxylic acid (or a carboxylic acid halide) in the presence of an acid catalyst. A material of the synthetic ester wax may for example be a commercially available synthetic or a substance derived from a natural product such as a long-chain fatty acid prepared from a natural oil. Carnauba wax or rice wax is preferable for example as the natural eater wax.

(Charge Control Agent)

The toner mother particles may optionally contain a charge control agent. The charge control agent is used for example for the purpose of improving charge stability or a charge rise characteristic of the toner. The charge rise characteristic of the toner is an indicator as to whether the toner can be charged to a specific charge level in a short period of time.

When the toner mother particles contain a negatively chargeable charge control agent (specific examples include an organic metal complex and a chelate compound), anionic strength of the toner mother particles can be increased. By contrast, when the toner mother particles contain a positively chargeable charge control agent (specific examples include pyridine, nigrosine, and quaternary ammonium salt), cationic strength of the toner mother particles can be increased. However, it is not essential to use a charge control agent in the toner mother particles if sufficient chargeability of the toner can be ensured without the charge control agent.

(Magnetic Powder)

The toner mother particles may optionally contain a magnetic powder. Examples of a material of the magnetic powder that can be preferably used include ferromagnetic metals (specific examples include iron, cobalt, nickel, and an alloy containing at least one of them), ferromagnetic metal oxides (specific examples include ferrite, magnetite, and chromium dioxide), and materials subjected to ferromagnetization (specific examples include carbon materials to which ferromagnetism is imparted through heat treatment). A single magnetic powder may be used or two or more magnetic powders may be used in combination.

[External Additive]

An external additive (specifically, a powder including a plurality of external additive particles) may be attached to the surfaces of the toner mother particles. Unlike the internal additive, the external additive is not present inside the toner mother particles and selectively present on the surfaces of the toner mother particles (surface layer portions of the toner particles). For example, stirring the toner mother particles (powder) together with the external additive (powder) attaches the external additive to the surfaces of the toner mother particles. The toner mother particles and the external additive particles are bonded together physically rather than chemically without chemical reaction therebetween. Bonding strength between the toner mother particles and the external additive particles can be adjusted for example through adjustment of stirring conditions (specific examples include time period and rotational speed of stirring) and particle diameter, shape, and surface state of the external additive particles.

In order to inhibit desorption of the external additive particles from the toner particles and allow the external additive to fully exhibit its function, the amount of the external additive (where plural external additives are use, a total amount of the external additives) is preferably at least 0.5 parts by mass and no greater than 10 parts by mass relative to 100 parts by mass of the toner mother particles.

The external additive particles are preferably inorganic particles and particularly preferably silica particles or particles of a metal oxide (specific examples alumina, titanium oxide, magnesium oxide, zinc oxide, strontium titanate, and barium titanate). However, resin particles or particles of an organic acid compound such as a fatty acid metal salt (a specific example is zinc stearate) may be used as the external additive particles. Alternatively, composite particles that are made from a complex of plural types of materials may be used as the external additive particles. The external additive particles may be subjected to surface treatment. A single external additive may be used or two or more external additives may be used in combination.

It is preferable to use inorganic particles (powder) having a number average primary particle diameter of at least 5 nm and no greater than 30 nm as the external additive particles in order to improve fluidity of the toner. It is preferable to use resin particles (powder) having a number average primary particle diameter of at least 50 nm and no greater than 200 nm as the external additive particles in order to improve heat-resistant preservability of the toner by allowing the external additive to function as a spacer among the toner particles.

EXAMPLES

The following describes examples of the present invention. Table 1 lists toners TA-1 to TA-7 and TB-1 to TB-7 (each are an electrostatic latent image developing toner) of Examples or Comparative Examples.

TABLE 1

| | Core | | | | |
|---|---|---|---|---|---|
| | Crystalline polyester resin | | Releasing | High-temperature leaving (40° C., | Shell |
| Toner | Type | Amount [g] | agent | 72 hours) | layer |
| TA-1 | PB-5 | 100 | A | Done | Present |
| TB-1 | PB-3 | 100 | A | Not done | Present |
| TA-2 | PB-2 | 75 | A | Not done | Absent |
| TB-2 | PB-2 | 100 | A | Not done | Absent |
| TA-3 | PB-1 | 75 | A | Done | Absent |
| TB-3 | PB-1 | 75 | A | Not done | Absent |
| TA-4 | PB-4 | 100 | A | Done | Present |
| TB-4 | PB-4 | 100 | A | Not done | Present |
| TA-5 | PB-2 | 75 | A | Done | Present |
| TB-5 | PB-2 | 75 | A | Not done | Present |
| TA-6 | PB-5 | 75 | A and B | Done | Absent |
| TB-6 | PB-5 | 75 | A and B | Not done | Absent |
| TA-7 | PB-1 | 75 | A and B | Done | Present |
| TB-7 | PB-1 | 75 | A and B | Not done | Present |

The following describes production methods, evaluation methods, and evaluation results for the respective toners TA-1 to TA-7 and TB-1 to TB-7 in stated order. In evaluations in which errors may occur, an evaluation value was calculated by calculating the arithmetic mean of an appropriate number of measured values in order to ensure that any errors were sufficiently small. Respective methods of measuring a glass transition point (Tg), a melting point (Mp), and a softening point (Tm) are those described below unless otherwise stated.

<Tg Measuring Method>

A differential scanning calorimeter ("DSC-6220" produced by Seiko Instruments Inc.) was used as a measuring device. The Tg (glass transition point) of a sample was determined by plotting a heat absorption curve of the sample using the measuring device. Specifically, approximately 10 mg of a sample (for example, a resin) was placed on an aluminum pan (aluminum container) and the aluminum pan was set in a measurement section of the measuring device. An empty aluminum pan was used as a reference. In plotting the heat absorption curve, the temperature of the measurement section was increased from a measurement starting temperature of 25° C. to 200° C. at a rate of 10° C./minute (RUN1). The temperature of the measurement section was then decreased from 200° C. to 25° C. at a rate of 10° C./minute. Subsequently, the temperature of the measurement section was re-increased from 25° C. to 200° C. at a rate of 10° C./minute (RUN2). Through RUN2, the heat absorption curve (vertical axis: heat flow (DSC signal), horizontal axis: temperature) of the sample was plotted. The Tg of the sample was read from the plotted heat absorption curve. The Tg (glass transition point) of the sample corresponds to a temperature (onset temperature) at a point of change in specific heat on the heat absorption curve (an intersection point of an extrapolation of the base line and an extrapolation of the inclined portion of the curve).

<Mp Measuring Method>

A differential scanning calorimeter ("DSC-6220" produced by Seiko Instruments Inc.) was used as a measuring device. The Mp (melting point) of a sample was determined by plotting a heat absorption curve of the sample using the measuring device. Specifically, approximately 15 mg of a sample (for example, a resin) was placed on an aluminum pan (aluminum container) and the aluminum pan was set in a measurement section of the measuring device. An empty aluminum pan was used as a reference. In plotting the heat absorption curve, the temperature of the measurement section was increased from a measurement starting temperature of 30° C. to 170° C. at a rate of 10° C./minute. The heat absorption curve (vertical axis: heat flow (DSC signal), horizontal axis: temperature) of the sample was plotted during the temperature increase. The Mp of the sample was read from the plotted heat absorption curve. The Mp (melting point) of the sample corresponds to a temperature at a maximum peak resulting from heat of fusion on the heat absorption curve.

<Tm Measuring Method>

A sample (for example, a resin) was set in a capillary rheometer ("CFT-500D" produced by Shimadzu Corporation), and a sample having a volume of 1 $cm^3$ was allowed to melt-flow under conditions of a die pore size of 1 mm, a plunger load of 20 $kg/cm^2$, a heating rate of 6° C./minute to plot an S-shaped curve (horizontal axis: temperature, vertical axis: stroke) of the sample. Subsequently, the Tm (melting point) of the sample was read from the plotted S-shaped curve. The Tm (softening point) of the sample corresponds to a temperature on the S-shaped curve corresponding to a stroke of "$(S_1+S_2)/2$", where $S_1$ represents a maximum stroke value and $S_2$ represents a base line stroke value at low temperatures.

[Preparation of Materials]

(Synthesis of Non-Crystalline Polyester Resin PA-1)

A 10-L four-necked flask equipped with a thermometer (thermocouple), a dewatering conduit, a nitrogen inlet tube, and a stirrer was charged with 370 g of bisphenol A propylene oxide adduct, 3,059 g of bisphenol A ethylene oxide adduct, 1,194 g of terephthalic acid, 286 g of fumaric acid, 10 g of tin(II) 2-ethylhexanoate, and 2 g of gallic acid. Subsequently, the flask contents were caused to react in a nitrogen atmosphere at a temperature of 230° C. until the reaction rate became at least 90% by mass. The reaction rate was calculated in accordance with an expression "(reaction rate)=100×(actual amount of produced reaction water)/(theoretical amount of produced water)". Subsequently, the flask contents were caused to react in a reduced-pressure atmosphere (pressure: 8.3 kPa) at a temperature of 230° C. until a reaction product (resin) had a Tm of a specific temperature (89° C.). Through the above, a non-crystalline polyester resin PA-1 having a Tm of 89° C. and Tg of 50° C. was obtained.

(Synthesis of Non-Crystalline Polyester Resin PA-2)

A non-crystalline polyester resin PA-2 was synthesized according to the same method as the non-crystalline polyester resin PA-1 in all aspects other than that 1,286 g of bisphenol A propylene oxide adduct, 2,218 g of bisphenol A ethylene oxide adduct, and 1,603 g of terephthalic acid were used rather than 370 g of bisphenol A propylene oxide adduct, 3,059 g of bisphenol A ethylene oxide adduct, 1,194 g of terephthalic acid, and 286 g of fumaric acid. The resultant non-crystalline polyester resin PA-2 had a Tm of 111° C. and a Tg of 69° C.

(Synthesis of Non-Crystalline Polyester Resin PA-3)

A 10-L four-necked flask equipped with a thermometer (thermocouple), a dewatering conduit, a nitrogen inlet tube, and a stirrer was charged with 4,907 g of bisphenol A propylene oxide adduct, 1,942 g of bisphenol A ethylene oxide adduct, 757 g of fumaric acid, 2,078 g of dodecylsuccinic anhydride, 30 g of tin(II) 2-ethylhexanoate, and 2 g of gallic acid. Subsequently, the flask contents were caused to react in a nitrogen atmosphere at a temperature of 230° C. until the reaction rate expressed by the above expression became at least 90% by mass. The flask contents were then caused to react for one hour in a reduced-pressure atmosphere (pressure: 8.3 kPa) at a temperature of 230° C. Subsequently, 548 g of trimellitic anhydride was added to the flask and the flask contents were caused to react in a reduced-pressure atmosphere (pressure: 8.3 kPa) at a temperature of 220° C. until a reaction product (resin) had a Tm of a specific temperature (127° C.). Through the above, a non-crystalline polyester resin PA-3 having a Tm of 127° C. and Tg of 51° C. was obtained.

(Synthesis of Crystalline Polyester Resin PB-1)

A 10-L four-necked flask equipped with a thermometer (thermocouple), a dewatering conduit, a nitrogen inlet tube, and a stirrer was charged with 2,231 g of ethylene glycol, 5,869 g of suberic acid, 40 g of tin(II) 2-ethylhexanoate, and 3 g of gallic acid. Subsequently, the flask contents were caused to react for four hours in a nitrogen atmosphere at a temperature of 180° C. The temperature of the flask contents was then increased to cause reaction at a temperature of 210° C. for ten hours. Subsequently, the flask contents were caused to react for one hour in a reduced-pressure atmosphere (pressure: 8.3 kPa) at a temperature of 210° C. Through the above, a crystalline polyester resin PB-1 having a Tm of 88° C., a Mp of 84° C., and a crystallinity index (=Tm/Mp) of 1.05 was obtained.

(Synthesis of Crystalline Polyester Resin PB-2)

A crystalline polyester resin PB-2 was synthesized according to the same method as the crystalline polyester resin PB-1 in all aspects other than that 3,744 g of 1,6-hexanediol was used rather than 2,231 g of ethylene glycol. The resultant crystalline polyester resin PB-2 had a Tm of 80° C., a Mp of 72° C., and a crystallinity index (=Tm/Mp) of 1.11.

(Synthesis of Crystalline Polyester Resin PB-3)

A crystalline polyester resin PB-3 was synthesized according to the same method as the crystalline polyester resin PB-1 in all aspects other than that 3,978 g of succinic acid was used rather than 5,869 g of suberic acid. The resultant crystalline polyester resin PB-3 had a Tm of 104° C., a Mp of 102° C., and a crystallinity index (=Tm/Mp) of 1.02.

(Synthesis of Crystalline Polyester Resin PB-4)

A crystalline polyester resin PB-4 was synthesized according to the same method as the crystalline polyester resin PB-1 in all aspects other than that 2,008 g of ethylene glycol, 1,136 g of bisphenol A ethylene oxide adduct, and 3,978 g of suberic acid were used rather than 2,231 g of ethylene glycol and 5,869 g of suberic acid. The resultant crystalline polyester resin PB-4 had a Tm of 87° C., a Mp of 92° C., and a crystallinity index (=Tm/Mp) of 0.94.

(Synthesis of Crystalline Polyester Resin PB-5)

A 10-L four-necked flask equipped with a thermometer (thermocouple), a dewatering conduit, a nitrogen inlet tube, and a stirrer was charged with 1,984 g of ethylene glycol and 4,345 g of suberic acid. Subsequently, the flask contents were heated to 160° C. to melt the added materials. A mixed liquid of styrene and the like (mixed liquid of 1,831 g of styrene, 161 g of acrylic acid, and 110 g of dicumyl peroxide) was then added dropwise to the flask over one hour using a dripping funnel. The flask contents were then allowed to react at a temperature of 170° C. for one hour while being stirred for polymerization of the styrene and the acrylic acid in the flask. Thereafter, non-reacted styrene and non-reacted acrylic acid in the flask were removed by keeping the flask contents in a reduced-pressure atmosphere (pressure: 8.3 kPa) for one hour. Subsequently, 40 g of tin(II) 2-ethylhexanoate and 3 g of gallic acid were added to the flask. The temperature of the flask contents was then increased to cause reaction at a temperature of 210° C. for eight hours. Subsequently, the flask contents were caused to react for one hour in a reduced-pressure atmosphere (pressure: 8.3 kPa) at a temperature of 210° C. Through the above, a crystalline polyester resin PB-5 having a Tm of 90° C., Mp of 83° C., and a crystallinity index (=Tm/Mp) of 1.09, was obtained.

(Shell Material: Preparation of Suspension A)

A 1-L three-necked flask equipped with a thermometer, a cooling tube, a nitrogen inlet tube, and a stirring impeller was charged with 90 g of isobutanol, 100 g of methyl methacrylate, 35 g of n-butyl acrylate, 30 g of 2-(methacryloyloxy)ethyl trimethylammonium chloride (product of Alfa Aesar), and 6 g of 2,2'-azobis(2-methyl-N-(2-hydroxyethyl) propionamide) ("VA-086" produced by Wako Pure Chemical Industries, Ltd.). Subsequently, the flask contents were caused to react for three hours in a nitrogen atmosphere at a temperature of 80° C. Thereafter, 3 g of 2,2'-azobis(2-methyl-N-(2-hydroxyethyl)propionamide) ("VA-086" produced by Wako Pure Chemical Industries, Ltd.) was added to the flask and the flask contents were caused to react for additional three hours in the nitrogen atmosphere at a temperature of 80° C., thereby obtaining a liquid containing a polymer. Subsequently, the resultant liquid containing the polymer was dried in a reduced-pressure atmosphere at a temperature of 150° C. The dried polymer was then broken to obtain a positively chargeable resin.

Next, 200 g of the positively chargeable resin obtained as above and 184 mL of ethyl acetate ("ethyl acetate JIS special grade" produced by Wako Pure Chemical Industries, Ltd.) were added to a vessel of a mixer ("Model 2P-1 HIVIS MIX (registered Japanese trademark)" produced by PRIMIX Corporation). The vessel contents were then stirred for one hour at a rotational speed of 20 rpm using the mixer to obtain a high-viscosity solution. Thereafter, an aqueous solution of ethyl acetate and the like (specifically, an aqueous solution of 562 g of ion-exchanged water in which 18 mL of 1N-hydrochloric acid, 20 g of a cationic surfactant ("TEXNOL (registered Japanese trademark) R5" produced by NIPPON NYUKAZAI CO., LTD., component: alkyl benzyl ammonium salt), and 20 mL of ethyl acetate ("ETHYL ACETATE JIS SPECIAL GRADE" produced by Wako Pure Chemical Industries, Ltd.) were dissolved) was added to the resultant high-viscosity solution. Through the above, a suspension A of resin fine particles (particles substantially formed from the first vinyl resin) was obtained. The resin particles contained in the resultant suspension A had a number average primary particle diameter of 35 nm and a Tg of 80° C.

(Shell Material: Preparation of Suspension B)

A 1-L three-necked flask equipped with a thermometer and a stirring impeller was set in a water bath at a temperature of 30° C., and 875 mL of ion-exchanged water and 5 g of an anionic surfactant ("EMAL (registered Japanese trademark) 0" produced by Kao Corporation, component: sodium lauryl sulfate) were added to the flask. Thereafter, the internal temperature of the flask was increased to 80° C. using the water bath. Two liquids (first and second liquids) were separately added dropwise to the flask at a temperature of 80° C. over five hours. The first liquid was a mixed liquid of 13 mL of styrene, 5 mL of 2-hydroxybutyl methacrylate, and 3 mL of ethyl acrylate. The second liquid was a solution of 30 mL of ion-exchanged water in which 0.5 g of potassium peroxodisulfate was dissolved. Subsequently, the internal temperature of the flask was kept at 80° C. for additional two hours for polymerization of the flask contents. Through the above, a suspension B of resin fine particles (particles substantially formed from a second vinyl resin) was obtained. The resin particles contained in the resultant suspension B had a number average primary particle diameter of 55 nm and a Tg of 73° C.

(External Additive: Preparation of Silica Particles)

Hydrophobic fumed silica particles ("AEROSIL (registered Japanese trademark) R972" produced by Nippon Aerosil Co., Ltd., number average primary particle diameter: 16 nm) were broken using a jet mill ("MODEL-I SUPER SONIC JET MILL", produced by Nippon Pneumatic Mfg.) to obtain silica particles (powder) for external additive use.

(External Additive: Preparation of Cross-Linked Resin Particles)

A 3-L flask equipped with a stirrer, a nitrogen inlet tube, a thermometer, and a condenser (heat exchanger) was charged with 1,000 g of ion-exchanged water and 4 g of a cationic surfactant ("TEXNOL (registered Japanese trademark) R5" produced by NIPPON NYUKAZAI CO., LTD., component: alkyl benzyl ammonium salt), and nitrogen substitution was performed for 30 minutes. The alkyl benzyl ammonium salt is expected to function as an emulsifier.

Next, 2 g of potassium peroxodisulfate was added to the flask while the flask contents were stirred to dissolve the potassium peroxodisulfate. Subsequently, the temperature of the flask contents was increased to 80° C. in a nitrogen atmosphere while the flask contents were stirred. When the temperature of the flask contents reached 80° C., dripping of a mixture of 250 g of methyl methacrylate and 4 g of 1,4-butanediol dimethacrylate into the flask was started. The mixed liquid was thoroughly dripped over two hours while the flask contents were stirred at a rotational speed of 300 rpm. After the dripping was finished, the flask contents were stirred for additional eight hours while the temperature of the flask contents was kept at 80° C. Subsequently, the flask contents were cooled to normal temperature (approximately 25° C.), thereby obtaining an emulsion of cross-linked resin particles. The resultant emulsion was then dried to obtain cross-linked resin particles (powder) for external additive use. The resultant cross-linked resin particles had a number average primary particle diameter of 84 nm and a glass transition point (Tg) of 114° C.

[Toner Production]

(Toner Core Production)

An FM mixer (product of Nippon Coke & Engineering Co., Ltd.) was used to mix 300 g of a first binder resin (non-crystalline polyester resin PA-1), 100 g of a second binder resin (non-crystalline polyester resin PA-2), 600 g of a third binder resin (non-crystalline polyester resin PA-3), a crystalline polyester resin (any of the crystalline polyester resins PB-1 to PB-5 listed in Table 1 for corresponding one of the toners) in the amount listed in Table 1, a releasing agent listed in Table 1 (either or both releasing agents A and B listed in Table 1 for corresponding one of the toners), and 144 g of a colorant ("COLORTEX (registered Japanese trademark) Blue B1021" produced by SANYO COLOR WORKS, Ltd., component: Phthalocyanine Blue) at a rotational speed of 2,400 rpm. The releasing agent A in Table 1 used was 48 g of a synthesized ester wax ("NISSAN ELECTOL (registered Japanese trademark) WEP-3" produced by NOF Corporation). The releasing agent B in Table 1 used was 12 g of a carnauba wax ("CARNAUBA WAX NO. 1" produced by S. Kato & Co.). In production of for example the toner TA-1, 100 g of the crystalline polyester resin PB-5 and 48 g of the releasing agent A ("NISSAN ELECTOL WEP-3") were added. In production of the toner TA-7, 75 g of the crystalline polyester resin PB-1, 48 g of the releasing agent A ("NISSAN ELECTOL WEP-3"), and 12 g of the releasing agent B ("Carnauba Wax no. 1") were added.

Subsequently, the resultant mixture was melt-kneaded using a twin-screw extruder ("PCM-30" produced by Ikegai Corp.) under conditions of a material feeding speed of 5 kg/hour, a shaft rotational speed of 160 rpm, and a set temperature (cylinder temperature) of 100° C. Thereafter, the resultant melt-knead substance was cooled. The cooled kneaded substance was then coarsely pulverized using a pulverizer ("Model 16/8 ROTOPLEX" produced by former Toa Machinery Mfg.). The resultant coarsely pulverized substance was then finely pulverized using a jet mill ("MODEL-I SUPER SONIC JET MILL" produced by Nippon Pneumatic Mfg.). Next, the resultant finely pulverized substance was classified using a classifier ("MODEL-EJ-LABO ELBOW JET" produced by Nittetsu Mining Co., Ltd.). Through the above, toner cores having a volume median diameter ($D_{50}$) of 6.2 μm and a Tg of 36° C. were obtained.

(High-Temperature Leaving)

The toner cores (powder) obtained as above were left to stand for 72 hours in an environmental test chamber of which the room temperature was kept at 40° C.

Note that the high-temperature leaving (72-hour standing still at a temperature of 40° C.) was not performed in production of the toners TA-2 and TB-1 to TB-7. The following shell layer formation was not performed in production of the toners TA-2, TA-3, TA-6, TB-2, TB-3, and TB-6.

(Shell Layer Formation)

A 1-L three-necked flask equipped with a thermometer and a stirring impeller was set in a water bath, and 300 mL of ion-exchanged water was charged into the flask. The internal temperature of the flask was then kept at 30° C. using the water bath. Subsequently, dilute hydrochloric acid was added to the flask to adjust the pH of the flask contents at 4. Next, 10 mL of the suspension A and 20 mL of the suspension B were added to the flask.

Subsequently, 300 g of the toner cores (toner cores produced through the aforementioned process) were added to the flask. The toner cores subjected to the high-temperature leaving were added in production of the toners TA-1 and TA-3 to TA-7.

The flask contents were stirred at a rotational speed of 300 rpm for one hour then. Subsequently, 300 mL of ion-exchanged water was added to the flask. The internal temperature of the flask was increased at a rate of 1° C./minute while the flask contents were stirred at a rotational speed of 100 rpm. When the temperature of the flask contents reached 73° C., sodium hydroxide was added to the flask to adjust the pH of the flask contents at 7. The flask contents were then cooled to normal temperature (approximately 25° C.) to obtain a toner mother particle-containing dispersion.

(Washing)

Filtration (solid-liquid separation) of the toner mother particle-containing dispersion obtained as above was performed using a Buchner funnel, thereby collecting a wet cake of the toner mother particles. Thereafter, the collected wet cake of the toner mother particles was re-dispersed in ion-exchanged water. Dispersion and filtration were repeated additional five times to wash the toner mother particles.

(Drying)

Next, the resultant toner mother particles were dispersed in an aqueous ethanol solution at a concentration of 50% by mass. Thus, a slurry of the toner mother particles was obtained. The toner mother particles in the slurry were then dried using a continuous surface-modifying apparatus ("COATMIZER (registered Japanese trademark)" produced by Freund Corporation) under conditions of a hot wind temperature of 45° C. and a flow rate of 2 $m^3$/minute.

(External Additive Addition)

A 10-L FM mixer (product of Nippon Coke & Engineering Co., Ltd.) was used to mix 100 parts by mass of the toner mother particles, 1.25 parts by mass of the resin particles (the cross-linked resin particles prepared through the above process), 1.50 parts by mass of the silica particles (silica particles prepared as above), and 1.00 parts by mass of conductive titanium oxide particles ("EC-100" produced by Titan Kogyo, Ltd., base material: $TiO_2$, coat layer: Sb-doped $SnO_2$ film, number average primary particle diameter: approximately 0.36 μm) for ten minutes. Through the above mixing, an external additive (the silica particles and the titanium oxide particles) was attached to the surfaces of the toner mother particles. Thereafter, sifting using a 200-mesh sieve (opening 75 μm) was performed. As a result, a toner (each toner TA-1 to TA-7 and TB-1 to TB-7) including multiple toner particles was obtained. The toner particles of each of the toners had a volume median diameter ($D_{50}$) of at least 6.0 μm and no greater than 6.5 μm.

Table 2 indicates measurement results of X-ray diffraction spectra, specific dispersion diameter releasing agent numbers, and specific dispersion diameter releasing agent area ratios for the respective toners TA-1 to TA-7 and TB-1 to TB-7 produced as above. For example, the toner TA-1 had an intensity value (diffraction X-ray intensity value) of 14,851 cps at a Bragg angle 2θ of 23.6° and that (diffraction X-ray intensity value) of 4,158 cps at a Bragg angle 2θ of 24.1°. A ratio (intensity ratio) of the intensity value at a Bragg angle 2θ of 24.1° relative to that at a Bragg angle 2θ of 23.6° was 28% (≈100×4,158/14,851) for the toner TA-1. The toner TA-1 had a specific dispersion diameter releasing agent number of 35 and a specific dispersion diameter releasing agent area ratio of 11%.

TABLE 2

| | X-ray diffraction intensity [cps] | | Releasing agent | |
|---|---|---|---|---|
| Toner | 2θ = 23.6° | 2θ = 24.1° (intensity ratio) | Area ratio [%] | Number (50-700 nm) |
| TA-1 | 14851 | 4,158 (28%) | 11 | 35 |
| TA-2 | 16797 | 5,711 (34%) | 7 | 29 |
| TA-3 | 13642 | 3,683 (27%) | 7 | 22 |
| TA-4 | 14108 | 4,797 (34%) | 14 | 36 |
| TA-5 | 15933 | 6,214 (39%) | 6 | 48 |
| TA-6 | 13026 | 2,735 (21%) | 18 | 17 |
| TA-7 | 13393 | 2,813 (21%) | 15 | 20 |
| TB-1 | 17089 | 3,760 (22%) | 21 | 13 |
| TB-2 | 14838 | 6,084 (41%) | 12 | 14 |
| TB-3 | 13321 | 2,531 (19%) | 5 | 13 |
| TB-4 | 13022 | 3,646 (28%) | 15 | 51 |
| TB-5 | 15326 | 4,445 (29%) | 4 | 42 |
| TB-6 | 12545 | 1,505 (12%) | 4 | 9 |
| TB-7 | 12941 | 2,847 (22%) | 5 | 18 |

The following describes respective measuring methods of the specific dispersion diameter releasing agent number, the specific dispersion diameter releasing agent area ratio, and the X-ray diffraction spectrum for each toner.

<X-Ray Diffraction Spectrum Measuring Method>

A sample (toner) was loaded into a sample holder of a parallel-sample multipurpose X-ray diffraction system ("ULTIMA IV" produced by Rigaku Corporation), and an X-ray diffraction spectrum (vertical axis: diffraction X-ray intensity, horizontal axis: diffraction angle) was measured under the following conditions. A compensation method (method of obtaining an intensity value) in a situation in which the base line of an X-ray diffraction spectrum was inclined toward the horizontal axis (diffraction angle: Bragg angle 2θ) of the graph representation is as described above (see FIG. 1).

(Measurement Conditions)

X-ray bulb: Cu.

Wavelength of CuKα characteristic X-ray: 1.542 Å.

Tube voltage: 40 kV.

Tube current: 30 mA.

Measurement range (2θ): 20° to 25°.

Scanning speed: 1°/minute.

Sampling interval: 0.005°.

Scanning axis: 2θ/θ.

Measurement type: continuous (continuous scanning).

Divergence slit (slit that sets divergence angle of X-ray): ⅔°.

Vertical divergence limiting slit (determining irradiation width in sample height direction): 10 mm.

Scattering slit (slit that removes scattering X-ray): open.

Light receiving slit (slit to optically adjusting angle resolution of data): open.

The X-ray diffraction spectra of the respective toners TA-1 to TA-7 and TB-1 to TB-7 obtained as above each had a halo peak resulting from a non-crystalline resin, a peak resulting from the crystal structure of a crystalline resin (peak position: Bragg angle 2θ of 24.0° to 24.2°), and a peak resulting from the crystal structure of a releasing agent (peak position: Bragg angle 2θ of 23.5° to 23.7°).

<Measuring Methods of Releasing Agent Area Ratio and Releasing Agent Number>

A sample (toner) was embedded in a visible photocurable resin ("ARONIX (registered Japanese trademark) D-800" produced by Toagosei Co., Ltd.) to obtain a hardened material. Thereafter, the hardened material was sliced at a slicing speed of 0.3 mm/second using a ultrathin piece forming knife ("SUMI KNIFE (registered Japanese trademark)" produced by Sumitomo Electric Industries, Ltd., a diamond knife having a blade width of 2 mm and a blade tip angle of 45°) and a ultramicrotome ("EM UC6" produced by Leica Microsystems) to form a thin piece having a thickness of 150 nm. The resultant thin piece was set on a copper mesh and exposed to vapor of an aqueous solution of ruthenium tetroxide for ten minutes for dying. Subsequently, an image of the cross-section of the dyed thin sample piece was captured at a magnification of 10,000× using a scanning transmission electron microscope (STEM) ("JSM-7600F" produced by JEOL Ltd.). The captured TEM image was analyzed using image analysis software ("WinROOF" produced by Mitani Corporation) to measure dispersion diameters (diameters) of respective releasing agent domains in cross-sections of toner particles. Note that average toner particles were selected as measurement targets from among toner particles included in a sample (toner). The toner particles that were measurement targets each had a maximum diameter in cross section of at least 5.5 μm. In a situation in which a cross-section of a releasing agent domain was not a perfect circle, the dispersion diameter of an equivalent circular diameter (the diameter of a circle that had the same area as a projection of the particle) was determined as a measurement value.

The area of a cross-section of a toner particle in the TEM image (specifically, an area of an inner region defined by a surface of the toner mother particle) was calculated. Subsequently, a ratio (specific dispersion diameter releasing agent area ratio) of a total area of releasing agent domains having a dispersion diameter of at least 50 nm and no greater than 700 nm that were dispersed in the toner mother particle (sum of areas of all of the releasing agent domains dispersed in the toner mother particle) relative to the calculated area of the cross section of the toner particle (entire sectional area of the toner) was measured. The specific dispersion diameter releasing agent area ratios were measured for cross sections of respective 50 toner particles, and the number average of the measured 50 measurement values was determined to be an evaluation value (specific dispersion diameter releasing agent area ratio) of the sample (toner).

The number of the releasing agent domains having a dispersion diameter of at least 50 nm and no greater than 700 nm (specific dispersion diameter releasing agent number) was counted among the releasing agent domains appearing in the cross-section of the toner particle in the TEM image. The specific dispersion diameter releasing agent numbers were counted for the cross-sections of respective 50 toner particles and the number average of the counted 50 measurement values was determined to be an evaluation value (specific dispersion diameter releasing agent number) of the sample (toner).

[Evaluation Methods]

The respective samples (toners TA-1 to TA-7 and TB-1 to TB-7) were evaluated according to the following methods.

(Heat-Resistant Preservability)

A 20-mL polyethylene container was charged with 2 g of a sample (toner) and left to stand in a thermostatic chamber set at 58° C. for three hours. Thereafter, the toner taken out from the thermostatic chamber was cooled to room temperature (approximately 25° C.), thereby obtaining an evaluation toner.

The resultant evaluation toner was then put on a 100-mesh (opening 150 μm) sieve of known mass. A mass of the toner on the sieve (mass of the toner prior to sifting) was calculated by measuring the total mass of the sieve and the toner thereon. The sieve was then set in a powder property evaluation device ("POWDER TESTER (registered Japanese trademark)" produced by Hosokawa Micron Corporation), and the evaluation toner was sifted by shaking the sieve for 30 seconds at a rheostat level of 5 in accordance with a manual of the powder tester. After the sifting, the mass of toner remaining on the sieve was calculated by once again measuring the total mass of the sieve and the toner thereon. An aggregation rate (unit: % by mass) was calculated based on the following equation from the mass of the toner prior to sifting and the mass of the toner after sifting (mass of the toner remaining on the sieve after sifting).

$$\text{(Aggregation rate)}=100\times\text{(mass of toner after sifting)}/\text{(mass of toner prior to sifting)}$$

An aggregation rate of no greater than 50% by mass was evaluated as G (good) and an aggregation rate of greater than 50% by mass was evaluated as P (poor).

(Charge Decay Characteristic)

An evaluation apparatus used was an electrostatic dissipation measuring device ("NS-D100" produced by Nano Seeds Corporation). The evaluation apparatus was capable of charging a measurement target and monitoring the state of charge decay of the charged measurement target using a surface electrometer. The evaluation method was a method in accordance with Japan Industrial Standard (JIS) C 61340-2-1-2006. The following describes in detail a method of charge decay constant evaluation.

A sample (toner) was set in a measurement cell. The measurement cell was a metal cell with a recess having an inner diameter of 10 mm and a depth of 1 mm. The toner was thrust from above using a glass slide to fill the recess of the cell with the toner. Any of the toner that overflowed from the cell was removed by moving the glass slide back and forth on the surface of the cell. The amount of toner filled therein was 50 mg.

Subsequently, the measurement cell filled with the toner was left to stand for 24 hours in an environment of a temperature of 32° C. and a relative humidity of 80%. The measurement cell was then grounded and placed in the evaluation apparatus. The surface electrometer of the evaluation apparatus was adjusted to zero. Next, the toner was charged by corona discharge under conditions of a voltage of 10 kV and a charge time period of 0.5 seconds. After 0.7 seconds elapsed from termination of the corona discharge, the surface potential of the toner was continuously recorded under conditions of a sampling frequency of 10 Hz and a maximum measurement period of 300 seconds. A charge decay constant $\alpha$ in a decay period of 2 seconds was calculated based on the recorded surface potential data and an expression "$V=V_0\exp(-\alpha\sqrt{t})$". In the expression, V represents a surface potential [V], $V_0$ represents an initial surface potential [V], and t represents a decay period [second].

A charge decay constant of no greater than 0.0250 was evaluated as G (good) and a charge decay constant of greater than 0.0250 was evaluated as P (poor).

(Preparation of Two-Component Developer)

A two-component developer was prepared by mixing 100 parts by mass of a developer carrier (carrier for "TASKalfa 5550ci" produced by KYOCERA Document Solutions Inc.) and 5 parts by mass of a sample (toner) for 30 minutes using a mixer (TURBULA (registered Japanese trademark) Mixer T2F" produced by Willy A. Bachofen AG (WAB)). The toner after the mixing was charged positively. The two-component developer prepared as above was used for respective evaluation of low-temperature fixability and sleeve contamination, which will be described later.

(Low-Temperature Fixability)

An image was formed using the two-component developer prepared as above for evaluation of low-temperature fixability of a toner. Fixability was evaluated using a color printer ("FS-C5250DN" produced by KYOCERA Document Solutions Inc., modified to enable adjustment of fixing temperature) including a roller-roller type heat-pressure fixing device as an evaluation apparatus. The two-component developer prepared as above was loaded into a developing device of the evaluation apparatus, and a sample (toner for replenishment use) was loaded into a toner container of the evaluation apparatus.

A solid image (specifically, an unfixed toner image) having a size of 25 mm by 25 mm was formed on a recording medium (A4-size plain paper having a basis weight of 90 g/m$^2$) using the evaluation apparatus under conditions of a linear velocity of 200 mm/second and a toner application amount of 1.0 mg/cm$^2$. Subsequently, the paper on which the image had been formed was subjected to fixing by the fixing device of the evaluation apparatus.

The fixing temperature was set in a measurement range from 100° C. to 200° C. in the evaluation of low-temperature fixability. Specifically, a lowest temperature (minimum fixing temperature) at which the solid image (toner image) was fixable was determined by gradually increasing the fixing temperature of the fixing device in increments of 5° C. (in increments of 2° C. around the minimum fixing temperature) starting from 100° C. Fixing of the toner was confirmed by a fold-rubbing test such as described below. Specifically, the fold-rubbing test was performed by folding the evaluation paper subjected to fixing by the fixing device in half such that a surface on which the image had been formed was folded inwards and a 1-kg weight covered with cloth was rubbed back and forth on the fold five times. Next, the paper was opened up and a fold portion of the paper (a portion to which the solid image was fixed) was observed. The length of toner peeling of the fold portion (peeling length) was measured. The minimum fixing temperature is determined to be the lowest temperature among fixing temperatures for which the peeling length is no greater than 1 mm. A minimum fixing temperature of no greater than 145° C. was evaluated as G (good) and a minimum fixing temperature of greater than 145° C. was evaluated as P (poor).

(Sleeve Contamination)

A color multifunction peripheral ("TASKalfa 5550ci" produced by KYOCERA Document Solutions Inc.) was used as an evaluation apparatus. The two-component developer prepared through the above process was loaded into a developing device of the evaluation apparatus, and a sample (toner for replenishment use) was loaded into a toner container of the evaluation apparatus.

Continuous printing at a coverage rate of 5% was performed on 3,000 pieces of paper (A4-size printing paper) using the evaluation apparatus in an environment of a temperature of 32° C. and a relative humidity of 80% while toner for replenishment use was supplied from the toner container. The surface of a development sleeve of the evaluation apparatus was visually observed after every 200$^{th}$ printing in the continuous printing. Sleeve contamination was evaluated in accordance with the following criteria.

G (good): No coloring with toner on the surface of the development sleeve was observed during the 3,000-piece continuous printing.

P (poor): Coloring with toner on the surface of the development sleeve was observed at a time point in the 3,000-piece continuous printing.

[Evaluation Results]

Table 3 indicates evaluation results for each sample (toners TA-1 to TA-7 and TB-1 to TB-7). Table 3 lists respective evaluation results of heat-resistant preservability (aggregation rate), low-temperature fixability (minimum fixing temperature), charge decay characteristic (charge decay constant), and sleeve contamination (adhesion or non-adhesion of toner).

TABLE 3

| | Toner | Heat-resistant preservability [% by mass] | Low-temperature fixability [° C.] | Charge decay | Sleeve contamination |
|---|---|---|---|---|---|
| Example 1 | TA-1 | 21 | 132 | 0.0231 | G |
| Example 2 | TA-2 | 44 | 124 | 0.0240 | G |
| Example 3 | TA-3 | 34 | 128 | 0.0202 | G |
| Example 4 | TA-4 | 48 | 120 | 0.0222 | G |
| Example 5 | TA-5 | 18 | 124 | 0.0225 | G |
| Example 6 | TA-6 | 20 | 124 | 0.0195 | G |
| Example 7 | TA-7 | 35 | 124 | 0.0207 | G |
| Comparative Example 1 | TB-1 | 5 | 128 | 0.0191 | P |
| Comparative Example 2 | TB-2 | 44 | 120 | 0.0257 (P) | G |
| Comparative Example 3 | TB-3 | 45 | 124 | 0.0219 | P |
| Comparative Example 4 | TB-4 | 41 | 120 | 0.0259 (P) | P |
| Comparative Example 5 | TB-5 | 21 | 120 | 0.0223 | P |
| Comparative Example 6 | TB-6 | 51 (P) | 122 | 0.0189 | P |
| Comparative Example 7 | TB-7 | 36 | 124 | 0.0211 | P |

The toners TA-1 to TA-7 (toners of Examples 1 to 7) each had the aforementioned basic features. Specifically, the toners TA-1 to TA-7 each included a plurality of toner particles containing a binder resin and a plurality of releasing agent domains dispersed in the binder resin. The toner particles contain a crystalline resin and a non-crystalline resin each as the binder resin. The number of releasing agent domains that each have a dispersion diameter of at least 50 nm and no greater than 700 nm was at least 15 and no greater than 50 per one toner particle in the cross-sections of the respective toner particles (see Table 2). The total area of the releasing agent domains that each have a dispersion diameter of at least 50 nm and no greater than 700 nm in the cross-sections of the respective toner particles was at least 5% and no greater than 20% relative to an area of the cross-sectional areas of the respective toner particles (see Table 2). The X-ray diffraction spectrum of the toner has an intensity value at a Bragg angle 2θ of 23.6° of at least 13000 cps and no greater than 17000 cps and an intensity value at a Bragg angle 2θ of 24.1° of at least 20% and no greater than 40% relative to the intensity value at a Bragg angle 2θ of 23.6° (see Table 2).

As indicated in Table 3, the toners TA-1 to TA-7 each were excellent in heat-resistant preservability, low-temperature fixability, and charge decay characteristic. When any of the toners TA-1 to TA-7 was used, toner adhesion (specifically, sleeve contamination) hardly caused in the continuous printing.

Sleeve contamination more readily occurred when the toner TB-1 (toner of Comparative Example 1) was used than when any of the toners TA-1 to TA-7 was used. In the toner TB-1, it is thought that compatibility between the crystalline resin (crystalline polyester resin PB-3) and the releasing agent domains (releasing agent A) was insufficient and therefore the releasing agent desorbed from the toner particles.

Charge decay of the toner TB-2 (toner of Comparative Example 2) occurred more readily than that of the toners TA-1 to TA-7. The crystalline resign (crystalline polyester resin PB-2) of the toner TB-2 was thought to be excessively crystalized.

Sleeve contamination more readily occurred when the toner TB-3 (toner of Comparative Example 3) was used than when any of the toners TA-1 to TA-7 was used. It is thought that the crystalline resin (crystalline polyester resin PB-1) and the releasing agent domains (releasing agent A) were excessively compatibilized in the toner TB-3.

Charge decay and sleeve contamination more readily occurred when the toner TB-4 (toner of Comparative Example 4) was used than when any of the toners TA-1 to TA-7 was used. It is thought that the crystalline resin (crystalline polyester resin PB-4) and the releasing agent domains (releasing agent A) were excessively compatibilized in the toner TB-4. Multiple small releasing agent domains were present in the toner particles of the toner TB-4 (see Table 2). Bleeding (exudation of the releasing agent) was thought to have occurred in the shell layer formation in the toner TB-4.

Sleeve contamination more readily occurred when the toner TB-5 (toner of Comparative Example 5) was used than when any of the toners TA-1 to TA-7 was used. It is thought that the crystalline resin (crystalline polyester resin PB-2) and the releasing agent domains (releasing agent A) were more excessively compatibilized than those in the toner TB-4 to decrease the specific dispersion diameter releasing agent area ratio in the toner TB-5 (see Table 2).

Heat-resistant preservability was poorer and sleeve contamination more readily occurred when the toner TB-6 (toner of Comparative Example 6) was used than when any of the toners TA-1 to TA-7 was used. It is thought that the crystalline resin (crystalline polyester resin PB-5) and the releasing agent domains (releasing agents A and B) were excessively compatibilized in the toner TB-6. The releasing agent B, which was a natural ester wax (carnauba wax), contained much non-reacted alcohol and carboxylic acid. It is thought that non-reacted alcohol and non-reacted carboxylic acid increased adhesion strength of the surfaces of the toner particles to impair heat-resistant preservability of the toner.

Sleeve contamination more readily occurred when the toner TB-7 (toner of Comparative Example 7) was used than when any of the toners TA-1 to TA-7 was used. It is thought that the crystalline resin (crystalline polyester resin PB-1)

and the releasing agent domains (releasing agents A and B) were excessively compatibilized in the toner TB-7. Bleeding (exudation of releasing agent) is thought to have occurred in shell layer formation in the toner TB-7.

INDUSTRIAL APPLICABILITY

The electrostatic latent image developing toner according to the present invention can be used for image formation for example using a copier, a printer, or a multifunction peripheral.

The invention claimed is:

1. An electrostatic latent image developing toner comprising a plurality of toner particles containing a binder resin and a plurality of releasing agent domains dispersed in the binder resin, wherein the toner particles contain a crystalline resin and a non-crystalline resin each as the binder resin, the number of releasing agent domains each having a dispersion diameter of at least 50 nm and no greater than 700 nm among the releasing agent domains is at least 15 and no greater than 50 per one toner particle in cross-sections of the respective toner particles, a total area of the releasing agent domains that each have a dispersion diameter of at least 50 nm and no greater than 700 nm in the cross-sections of the respective toner particles is at least 5% and no greater than 20% relative to an area of the cross-sections of the respective toner particles an X-ray diffraction spectrum of the electrostatic latent image developing toner has an intensity value at a Bragg angle 2θ of 23.6° of at least 13,000 cps and no greater than 17,000 cps and an intensity value at a Bragg angle 2θ of 24.1° of at least 20% and no greater than 40% relative to the intensity value at a Bragg angle 2θ of 23.6°, the crystalline resin is a crystalline polyester resin, the non-crystalline resin is a non-crystalline polyester resin, the toner particles each includes a core and a shell layer covering a surface of the core, and the shell layer contains a first vinyl resin and a second vinyl resin, the first vinyl resin including at least one repeating unit derived from a nitrogen-containing vinyl compound, the second vinyl resin including at least one repeating unit having an alcoholic hydroxyl group.

2. The electrostatic latent image developing toner according to claim 1, wherein the crystalline polyester resin is a polymer of monomers including at least one aliphatic diol and at least one aliphatic dicarboxylic acid having a carbon number of at least 6 and no greater than 12, and the non-crystalline polyester resin is a polymer of monomers including at least one bisphenol and at least one dicarboxylic acid.

3. The electrostatic latent image developing toner according to claim 2, wherein the crystalline polyester resin is a polymer of monomers including suberic acid and hexanediol.

4. The electrostatic latent image developing toner according to claim 1, wherein the crystalline polyester resin is a polymer of monomers including at least one aliphatic diol, at least one bisphenol, and at least one aliphatic dicarboxylic acid having a carbon number of at least 6 and no greater than 12, and the non-crystalline polyester resin is a polymer of monomers including at least one bisphenol and at least one dicarboxylic acid.

5. The electrostatic latent image developing toner according to claim 1, wherein the toner particles contain a plurality of non-crystalline polyester resins having different softening points each as the non-crystalline resin.

6. The electrostatic latent image developing toner according to claim 1, wherein the plurality of releasing agent domains include a releasing agent domain containing an ester wax.

7. The electrostatic latent image developing toner according to claim 6, wherein the plurality of releasing agent domains further include a releasing agent domain containing a carnauba wax.

8. The electrostatic latent image developing toner according to claim 1, wherein a crystalline region and a non-crystalline region of the crystalline resin are present in each of the toner particles, and the X-ray diffraction spectrum of the electrostatic latent image developing toner has a peak resulting from crystal structure of the crystalline resin at a Bragg angle 2θ of 24.0° to 24.2° and a peak resulting from crystal structure of the releasing agent domains at a Bragg angle 2θ of 23.5° to 23.7°.

9. The electrostatic latent image developing toner according to claim 1, wherein the repeating unit of the first vinyl compound derived from the nitrogen-containing vinyl compound is a repeating unit represented by the following formula (1), and the repeating unit of the second vinyl compound having the alcoholic hydroxyl group is a repeating unit represented by the following formula (2):

[Chemical formula 1]

(1)

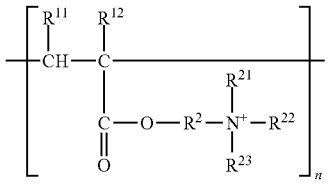

where in the formula (1), $R^{11}$ and $R^{12}$ each represent, independently of one another, a hydrogen atom, a halogen atom, or an optionally substituted alkyl group, $R^{21}$, $R^{22}$, and $R^{23}$ each represent, independently of one another, a hydrogen atom, an optionally substituted alkyl group, or an optionally substituted alkoxy group, and $R^2$ represents an optionally substituted alkylene group, and

[Chemical formula 2]

(2)

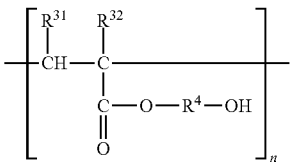

where in formula (2), $R^{31}$ and $R^{32}$ each represent, independently of one another a hydrogen atom, a halogen atom, or an optionally substituted alkyl group, and $R^4$ represents an optionally substituted alkylene group.

* * * * *